United States Patent [19]

Kankaanpää

[11] 4,172,759

[45] Oct. 30, 1979

[54] PAPER-MACHINE STRUCTURE AND METHOD FOR SUBJECTING A WEB TO SUCTION

[75] Inventor: Matti Kankaanpää, Espoo, Finland

[73] Assignee: Valmet Oy, Finland

[21] Appl. No.: 832,582

[22] Filed: Sep. 12, 1977

[30] Foreign Application Priority Data

Sep. 13, 1976 [FI] Finland ..... 762620
Jul. 6, 1977 [FI] Finland ..... 772129

[51] Int. Cl.[2] ..... D21F 3/10

[52] U.S. Cl. ..... 162/205; 162/305; 162/306; 162/360 R; 162/364; 162/372; 162/373

[58] Field of Search ..... 162/205, 206, 290, 305, 162/306, 359, 360 R, 360 DP, 364, 368, 369, 371, 372, 358, 373; 29/121.6

[56] References Cited

U.S. PATENT DOCUMENTS

| | | | |
|---|---|---|---|
| 2,772,606 | 12/1956 | Kelly | 162/371 X |
| 3,057,402 | 10/1962 | Webster | 162/368 |
| 3,440,138 | 4/1969 | Smith | 162/364 X |
| 3,527,668 | 9/1970 | Kusters et al. | 162/358 X |
| 3,560,333 | 2/1971 | Douglas et al. | 162/359 X |
| 3,718,959 | 3/1973 | Sailas | 29/121.6 |
| 3,826,713 | 7/1974 | Nykopp | 162/205 |
| 3,861,996 | 1/1975 | Dorfel | 162/360 R |

*Primary Examiner*—Richard V. Fisher
*Attorney, Agent, or Firm*—Steinberg & Blake

[57] ABSTRACT

In a paper-manufacturing machine a web is subjected to suction by placing a space between the web and a suction roll lapped thereby in communication with a region of substantially less than atmospheric pressure which is maintained at a part of the suction roll which is not lapped by the web. The structure includes a jacket which defines with the part of the suction roll which is not lapped by the web a hollow region with which a source of suction communicates. This hollow region of less than atmospheric pressure is situated at the exterior of the suction roll and bounded in part by an exterior surface of the suction roll, so that the hollow interior of the shell of the suction roll need not necessarily be utilized for providing the suction at the web.

18 Claims, 15 Drawing Figures

PAPER-MACHINE STRUCTURE AND METHOD FOR SUBJECTING A WEB TO SUCTION

BACKGROUND OF THE INVENTION

The present invention relates to paper-manufacturing machines and methods.

In particular, the present invention relates to a paper-manufacturing machine and method utilized to subject to suction a web or fiber-suspension layer which is supported by a felt or wire or other equivalent fabric which is guided around part of a roll of the machine.

Suction rolls are commonly utilized at the wet end of paper machines, which is to say in connection with the wire section and press section, for example as a sheet-forming roll, a couch roll, a pick-up roll, a felt-conditioning roll, and a press roll.

Known suction rolls conventionally include a rotating perforated cylindrical shell within which there is a stationary suction box extending parallel to the axis of the rotary shell, this suction box communicating through suitable seals with the inner surface of the cylindrical shell. Such a stationary suction box may have a width on the order of, for example, 100–500 mm, while extending in length from one end of the shell to the other end thereof. Such suction boxes are connected to a suction system in such a way that, when holes which pierce through the shell of the suction roll are in communication with the suction box, air flows through the holes which pierce through the shell into the suction box to achieve a suction at the exterior of the shell at that portion thereof which is in register with the suction box at any particular instant while the shell rotates.

The operation of such a suction box is that a wet paper web which has been formed at the sheet-forming section of the paper machine is conducted over the suction zone of the suction roll, while being supported either by a wire or felt, so that any vacuum which prevails at this location promotes the escape of water from the web through the holes into the suction box. Water extracted in this way from the web may travel through the holes as a result of the effect of the suction in the suction box, or the water may remain in the holes of the shell of the suction roll. In the latter event, water will remain in the holes in the shell as long as the holes are subjected to the effect of suction while air flows through the holes. However, the water is flung out of the shell of the suction roll when the holes turn beyond the suction zone.

The shell of such a conventional suction roll has a thickness of 50–100 mm, depending upon the dimensioning of the entire roll. The roll diameter and shell thickness are selected in such a way that deflection of the roll during operation of the paper manufacturing machine remains within permissible limits.

A conventional wire suction roll will have between 10,000 and 12,000 holes per square meter, and the diameter of each such hole is on the order of 5–6 mm. Suction rolls which are utilized in the press section of a paper machine have a larger number of holes in the shells thereof, but these holes have a smaller diameter, on the order of 4–5 mm.

Suction rolls are expensive components of paper-manufacturing machines. The drilling of the shells of the suction holes is particularly difficult, thus contributing to the high cost thereof. The perforations formed in the shell of a suction roll detract from the strength of the shell, and it therefore becomes necessary to utilize special alloys as raw materials for the suction rolls, as well as a considerable shell thickness, thus creating high material costs.

The air which enters into the suction box of the suction roll and which must be handled by the suction pump which is connected to the suction rolls originates from three sources:

(1) the air coming through the web, (2) the air entrained into the suction zone along with the holes, in the interior of the latter, during each revolution of the suction roll, (3) rogue air which enters the suction box as a result of seal leakage. This latter air is as a rule exceedingly minor representing only a small quantity, as compared to the first two sources referred to above. Thus, the major quantity of air received in the suction box is derived from the above first two sources.

The table following below illustrates the proportions between the first two air sources. The particular figures given refer to a suction roll in a particular paper machine, this roll having a length of seven meters and a suction box the width of which is 110 mm. The vacuum utilized is 550 mm Hg.

| Machine speed (m/min) | Hole air ($m^3$/min) | Through the web ($m^3$/min) |
|---|---|---|
| 700 | 180 | 105 |
| 1000 | 260 | <105 |

It is thus apparent from the above table that the air which arrives into the suction zone by way of the holes in the shell of the suction roll and which is carried into the suction system from these holes is unexpectedly high in modern, fast-operating paper machines. The higher the speed of operation of the machine, the greater will be the proportion of "hole" air. In other words the shell of the suction roll is formed with holes which pierce through the shell and which have air situated therein when these holes are situated beyond the suction box, and it is this air which is situated in the holes which is carried to the suction zone and drawn into the suction box and which represents an unusually high proportion of the air which is drawn into the suction box. This proportion of "hole" air is even further increased by the fact that with increasing machine speeds the rolls must be made of even greater strengths, and this greater strength is most often brought about by increasing the thickness of the shell of the suction roll. As a result the length of the holes piercing through the shell become longer and additional "hole" air is conveyed into the suction zone. Thus, the "hole" air quantity is proportional to the thickness of the roll shell.

In a particular newsprint machine having the speed of 1,000 m/min and a trimmed breadth of 8.5 m, the suction pump capacity required for handling the "hole" air, when considering all of the suction rolls combined, totals 108,000 $m^3$/hr, and the corresponding motor power which is required to drive the suction pumps is 2100 kW. If it is possible to reduce the suction pump power by 1000 kW, then there will be a saving of more than 7,000,000 kWh per year.

A further drawback encountered in operating techniques associated with conventional suction rolls is that the suction rolls generate loud noises, to the extent that such noise imposes severe health risks on the workers. It is possible to describe the manner in which this noise is generated. Thus, the holes in the shell of the suction roll act as whistles. As those holes which are subjected to vacuum travel beyond the suction zone, they are abruptly filled with air, and it is precisely at this point where the air rushes into the holes that a loud whistling noise is created, this loud whistling having a fundamental frequency equivalent to the acoustical resonating frequency of the hole. The multitude of numerous holes which are present in the suction roll created noise which frequently exceeds the pain limit of the human ear. Attempts have already been made to attenuate this noise by various arrangements such as by employing a suitable drilling pattern for the holes, but in practice no substantial attenuation of this noise has been achieved.

In connection with suction rolls at the press section, it is often essential to provide for deflection compensation, but this has not been possible heretofore because the space within the roll shell is already occupied by the suction box. As a result it has been impossible to accommodate any deflection-compensating means, which in themselves are known, in the hollow interior of the shells of section rolls in the press section.

Moreover, when in the press section use is made of grooved rolls which have at the exterior surface of the shell relatively wide grooves, such wide roll grooves create undesirable markings on the web.

SUMMARY OF THE INVENTION

In order to avoid the drawbacks as set forth above, it is one of the primary objects of the present invention to provide a suction roll construction according to which the shell of the suction roll has a much smaller number of holes than in conventional shells, while at the same time providing for the method and structure of the invention an effective suction which acts on the web.

It is furthermore an object of the present invention to provide a method and structure which make it possible to reduce the proportion of "hole" air at the suction zone to such an extent as to be virtually negligible.

Yet another object of the present invention is to provide a method and structure which make it possible to reduce very substantially the noise created by the suction rolls.

Furthermore, it is an object of the present invention to provide a suction roll construction according to which the interior of the shell of the suction roll is available for accommodating deflection-compensating structure which in itself is known.

Furthermore, it is an object of the present invention to provide a structure and method according to which there is a prevention of formation of web markings which otherwise would occur due to relatively wide grooves at the exterior of the suction roll.

According to the method of the invention, that part of a suction roll which is not lapped by the web which is subjected to suction is connected to a suction system only by way of structure at the exterior of the roll.

With the structure of the invention the suction-roll means includes a rotary shell which may either have holes piercing therethrough or which may have exterior recesses which extend only partly through the shell. A suction chamber is provided at the exterior of the shell over an extremely large portion thereof, namely the portion which is not lapped by the web, with the suction chamber having at its margins suitable seals which engage the roll, and the suction chamber is provided at its ends with seals which engage exterior surfaces at the ends of the roll shell. This latter exterior suction chamber, part of which is bounded by the exterior surface of the shell itself, is connected to a suction pump, and at the same time provision is made for drainage of water from the interior of the suction chamber, most appropriately by downwardly extending suction pipes through which water which accumulates in the suction chamber can be drained therefrom.

In the present application a suction roll is understood to be any roll which has a recessed surface and by means of which a fiber suspension layer or fiber web is subjected to suction as it laps the suction roll while being supported by a felt or wire during travel of the web past the suction roll, so that the latter is partially covered by the web. It is also to be understood that the expression "lapping" in the present application does not necessarily mean that the roll which is lapped is directly engaged by the web which laps the roll. In other words if a web is referred to as lapping a suction roll, it is to be understood that there may be between the web and the roll a suitable felt or wire. Of course suction rolls are also utilized to exert suction only on a felt alone, as for example, in felt-washing presses. Thus a web which is referred to as lapping a suction roll may be considered as referring to such a felt which is subjected to suction in a felt-washing press.

With respect to the prior art, reference may be made to U.S. Pat. No. 3,057,402 which shows a known suctional construction utilizing an external suction box in connection with a conventional perforated shell. With this construction of this patent there is an economy of the suction pump capacity and a reduction in the noise from the suction rolls, but the procedure illustrated in this patent still requires an expensive perforated suction roll.

It is thus a further object of the present invention to provide a suction roll construction which is less expensive than has heretofore been possible while still maintaining advantages of the type disclosed in the above patent. One embodiment of the present invention is advantageously capable of being utilized in the press section of a paper machine of the type known under the Trademark Sym-Press, or in a felt-washing press. It is also conceivable that, for example, this construction of the invention may be utilized in a cellulose web shaper or in a comparatively slow running paper machine.

In the present application a recessed surface suction roll is understood to be a roll to which a suction box is connected externally of the roll at a given sector thereof while the surface of the roll is, for example, grooved so as to permit in this way the suction which is produced to act in a region wider than the sector corresponding to the suction box itself, this region beyond the suction box being covered by a felt and/or a wire. Appropriately, such a roll may be a commonly used grooved roll such as, for example, a roll of the type disclosed in Finnish Pat. No. 45,583 (equivalent to U.S. Pat. No. 3,718,959). The grooves are advantageously comparatively wide, and they may be easily produced according to the teachings of the latter patent.

It is furthermore to be observed in this connection that a suction roll is indispensable in a roll combination of the Sym-Press type, where the first press nip is defined between two rolls one of which is above the other while the first press nip is also provided with a felt and in the nip the dewatering is symmetrical toward both of the rolls.

Thus in this type of construction suction is absolutely essential to aid in the transfer of water upwardly in the nip opposing the direction of the gravitational effect, and also for the purpose of preventing retransfer of water after the first nip zone back into the web from that felt on the surface of which the web travels to the next nip. Thus it is essential to retain the water as completely as possible within the fabric structure of the felt.

As is apparent from the above, it is possible to utilize according to the present invention a noiseless suction roll in the form of a grooved roll which is connected to an external suction box. The suction is controlled so as to project its action along the grooves at the exterior surface of the roll to a desired portion of the roll surface which is covered by a felt and by the web which engages the felt. In order to provide a suction which will reliably produce the desired effect it is necessary, however, that the grooves at the surface of the roll be relatively wide. This necessity in turn introduces the drawback that such a roll, and the pressing which takes place in connection therewith, tends to cause a marking of the web which is being manufactured, and of course such a marking is not desirable. The shell of the recessed surface roll utilized in certain embodiments of the invention may be made of one and the same material throughout while having machined recesses. However, it may also be formed of a solid body portion which is coated with a covering formed with recesses or cavities, or the shell may have a sandwich type of construction in which case the inner part of the roll shell is solid and is outer two portions form the recessed structure.

Of course it is known to use a wire fabric in the press section of a paper machine. According to prior art techniques such a wire fabric is used in the first place when it is desired to improve the dewatering process in a nip between two smooth rolls. By using such a wire fabric which laps the roll surface, a smooth roll surface can be removed water-receiving. It is thus possible with the aid of a wire fabric in some instances to replace, for example, a grooved roll or even a suction roll under certain service conditions.

According to one of the embodiments of the present invention, the task which is to be performed by the fabric is primarily different from that which has been encountered hitherto in fabric-press arrangements. By way of the present invention the marking which relatively wide roll grooves would otherwise cause is prevented by supporting the web with a supporting fabric having a particular construction according to the present invention.

Thus, according to the method of the present invention a web which is to be subjected to suction laps a rotary suction roll in such a way that air is to flow through the web into a space situated between the web and the axis of the suction roll. Substantially the entire exterior surface of the suction roll which is not lapped by the web forms part of a region situated at the exterior of the suction roll where a pressure of substantially less than atmospheric pressure is maintained, and this region communicates with the space between the web and the axis of the roll so as to provide at the latter space a pressure low enough to cause the air to flow through the web toward the axis of the suction roll.

The structure of the invention includes at the exterior of the suction-roll means substantially at the entire exterior surface portion thereof which is not lapped by the web, a jacket means which has a hollow interior bounded in part by the exterior of the suction-roll means which is not lapped by the web. This hollow interior region of the jacket means communicates with a source of suction, while the jacket means itself carries a sealing means which cooperates with the suction-roll means to seal the hollow interior region of the jacket means off from the outer atmosphere. At the same time, this hollow interior region communicates with the space between the web and roll axis to create the desired low pressure at the latter space.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
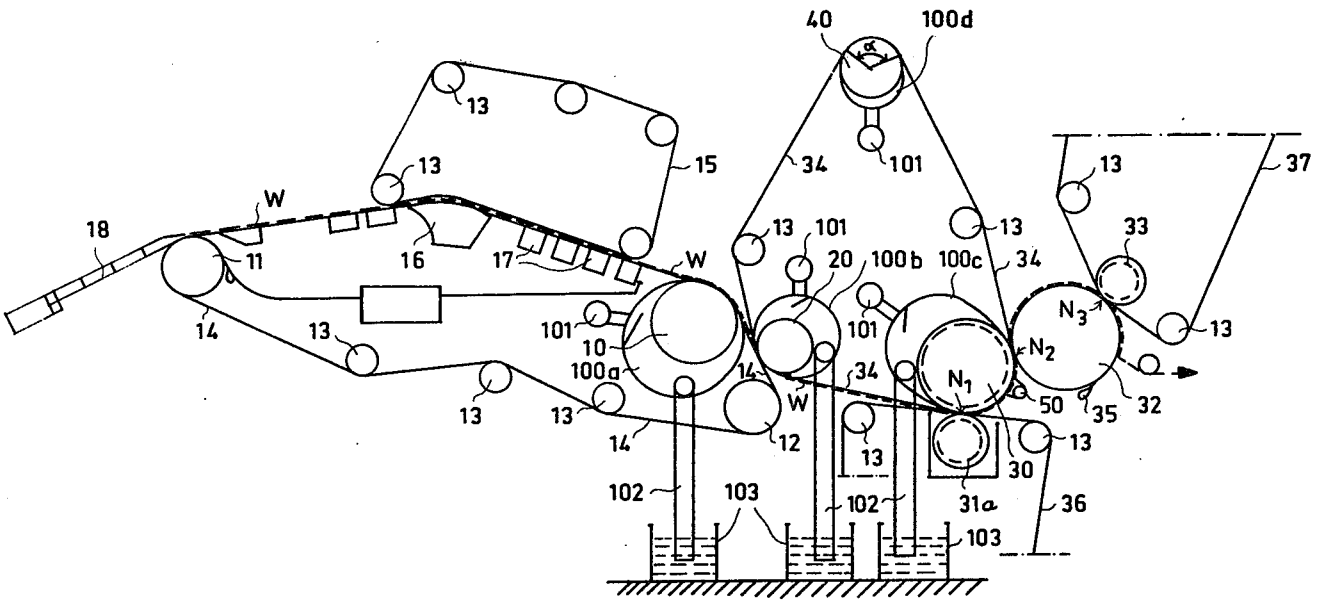
FIG. 1 is a schematic side elevation of the wet end of a paper machine where the method and apparatus of the invention are applied.

Referring to FIG. 1, there is illustrated therein the wet end of a paper-manufacturing machine, FIG. 1 illustrating the wire section and press section of the machine. The wire section includes, subsequent to the headbox 18, a single-wire portion formed by the endless wire 14, this single-wire portion being followed by a twin-wire portion formed by part of the wire 14 and by the endless wire 15, this twin-wire portion curving downwardly and being guided by a shoe 16 which preferably is provided with a closed cover. Subsequent to the guide shoe 16 the twin wires pass over the suction boxes 17 which are situated within the loop of the wire 14. A number of guide rolls 13 are provided for the wires 14 and 15 as well as for the felts which are referred to below. The wire 14 passes around the breast roll 11 and a return roll 12 which is furthest away from the breast roll 11. Within the loop of the wire 14 there is a suction-roll means 100*a* which has a structure according to the present invention and which operates as a couch roll. This suction roll means 100*a* includes a suction-roll per se 10 which has an outer shell which is pierced by openings passing therethrough.

The web W forms on the upper run of the wire 14 and after travelling beyond the means 100*a* reaches a pick-up means 100*b* which also has a construction according to the present invention and which serves to transfer the web W to an endless felt 34 which serves to transport the web W to the first nip $N_1$ of the press section. Thus, within the loop of the felt 34 there is adjacent to the couch roll 100*a* a pick-up roll means 100*b* which also has a construction according to the present invention and which includes a pick-up roll 20 per se which also is provided with a perforated shell. The endless felt 34 as well as the endless felt 37 shown at the right of FIG. 1 may each be provided with a felt-washing press which is known in itself, this felt-washing press having its own suction roll. This latter construction is not illustrated.

In the wet end of a paper-manufacturing machine as illustrated in FIG. 1, the press is a so-called Sym-Press which includes a twin-wire first nip $N_1$ defined between the felts 34 and 36 which in turn travel between the press rolls 30 and 31*a*, this press section including a second press nip $N_2$ which is defined between the roll 30 and a central smooth-surfaced press roll 32. This press roll 32 also forms part of a subsequent nip $N_3$ which is defined with the recessed surface roll 33. This nip $N_3$ includes the felt 37. The smooth surface of the central press roll 32 is kept clean by a doctor blade 35. After passing through the press the web W is conducted to the drying section of the paper machine by detaching the web from the surface of the roll 32 in a manner which in itself is known. The illustrated roll arrangement may also be utilized as a sheet-forming roll, for example as the forming roll disclosed in U.S. Pat. No. 3,846,232.

In the above-described press section the roll 30 forms part of a press-roll means 100*c* which includes the structure of the invention. As the web W passes upwardly from the nip $N_1$ to the nip $N_2$ it is exposed at the outer surface of the felt 34, and at this region there is illustrated a steam-supply means 50 which supplies steam to the web for enhancing the dewatering thereof.

In addition, as is illustrated in FIG. 1, the felt 34 is provided with a felt-reconditioning roll means 100*d* which includes the conditioning roll 40 per se and which also has a construction according to the present invention. The felt 37 may also be provided with a similiar felt-reconditioning means, in accordance with the invention.

Figure 2:
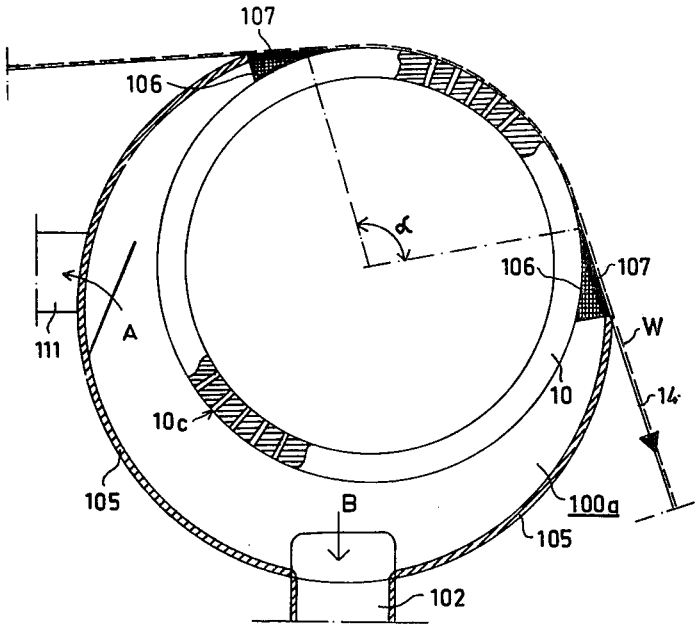
FIG. 2 is a schematic sectional elevation, in a plane normal to the suction roll axis, illustrating the structure of an apparatus of the invention which can serve as the couch roll for the forming wire.
Figure 3:
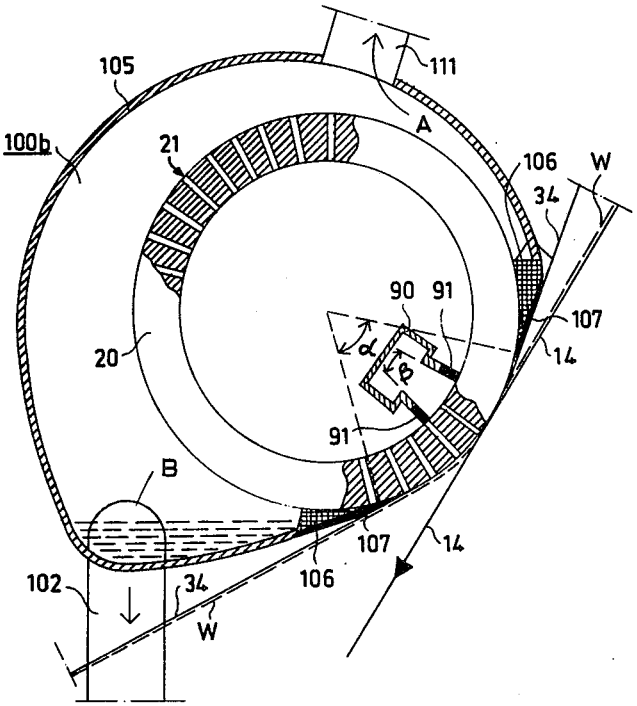
FIG. 3 is a schematic partly sectional elevation, taken in a plane normal to the roll axis, of that part of a structure of the invention which is utilized as the pick-up roll for transferring the web from the forming section of the press section.
Figure 6:
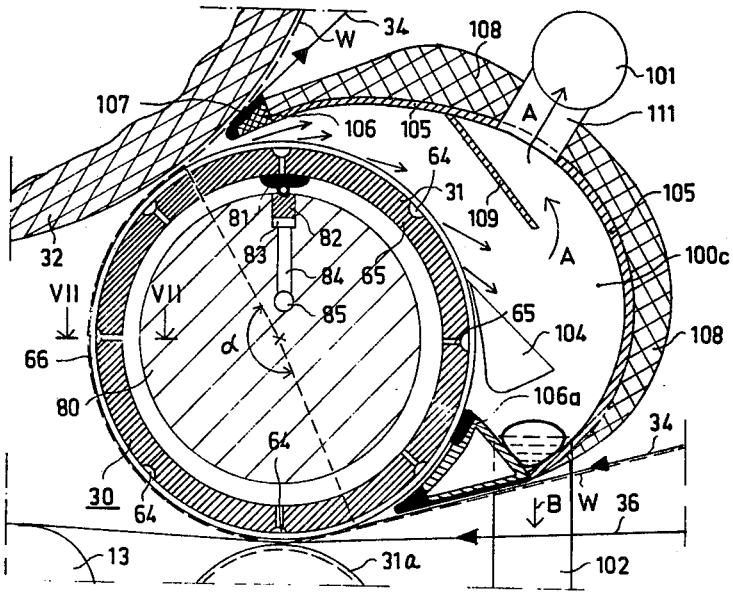
FIG. 6 shows schematically in a fragmentary partly sectional view taken in a plane normal to the roll axis, the construction of a roll of the invention which is utilized in the press section.
Figure 7:
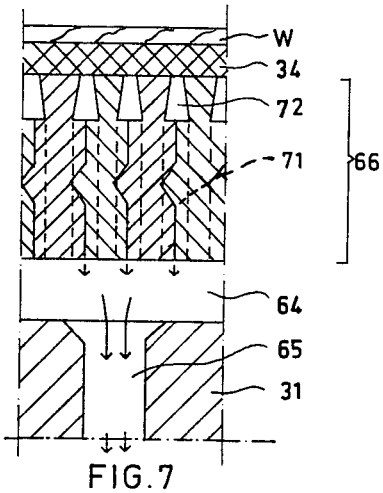
FIG. 7 is a fragmentary sectional view of part of the structure of FIG. 6 taken along line VII—VII of FIG. 6 in the direction of the arrows.
Figure 8:
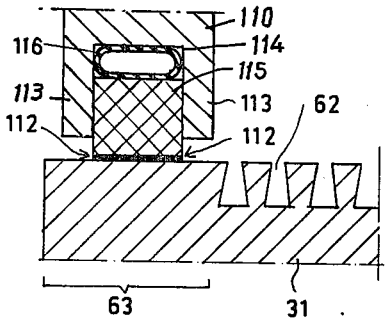
FIG. 8 is a fragmentary sectional view taken in a plane which contains the roll axis and illustrating the manner in which a sealing means cooperates with a suction roll shell.
Figure 9:
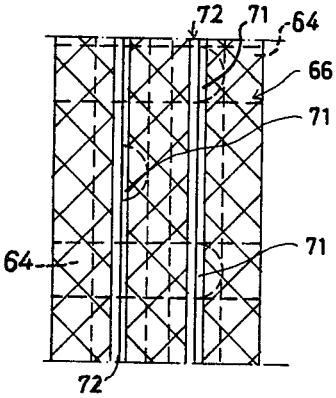
FIG. 9 is a fragmentary schematic developed view of part of the circumferential structure of a roll shell having grooves formed either by a series of rings or by winding a strip of suitable cross section, while also having holes which pass radially through the windings or rings.
Figure 10:
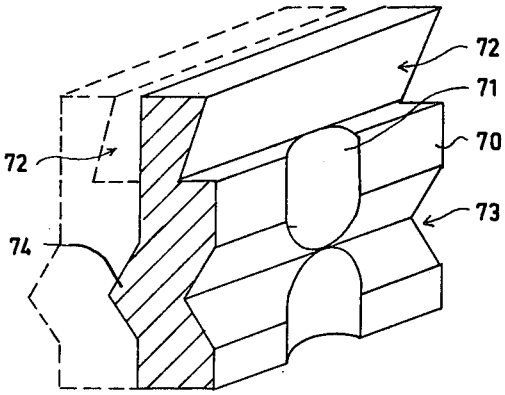
FIG. 10 is a partly sectional perspective illustration fragmentarily illustrating a portion of a strip which may be wound or a ring which may be placed with its center coinciding with the roll axis, the strip of the cross section or profile shown in FIG. 10 being utilized in the roll structure illustrated in FIGS. 7 and 9.
Figure 14:
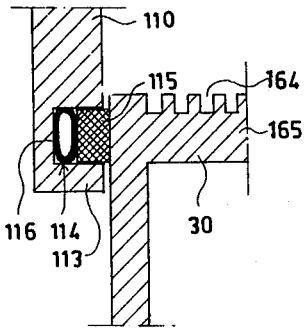
FIG. 14 illustrates a further embodiment of how a jacket means may have a sealing engagement with the end of a suction roll.

It will be seen from FIG. 1 that a suction roll means 40 of the unit 100*d* of the invention is lapped through the angle $\alpha$ by a web which in this case is formed by a portion of the felt 34, whereas the suction roll means 10, 20, and 30 which respectively form the couch roll, pick-up roll and press roll are illustrated respectively in FIGS. 2, 3, and 6 as being lapped respectively by the wire 14 and the felt 34 as well as the web W through the angle $\alpha$. According to the invention each of the above units 100*a*–100*d* includes at the part of the suction roll means which is not lapped by the web a jacket means 105 which defines with the exterior surface of the suction roll means which is not lapped by the web a hollow region which is substantially closed off from the outer atmosphere and which communicates with a source of suction. The jacket means 105 is provided at its longitudinal and end edge regions with a sealing means which includes along the opposed longitudinal edges which extend parallel to the axis of the suction roll means the components 106, 107 and at the ends the sealing components 115 as illustrated in FIGS. 8 and 14.

Figure 5:
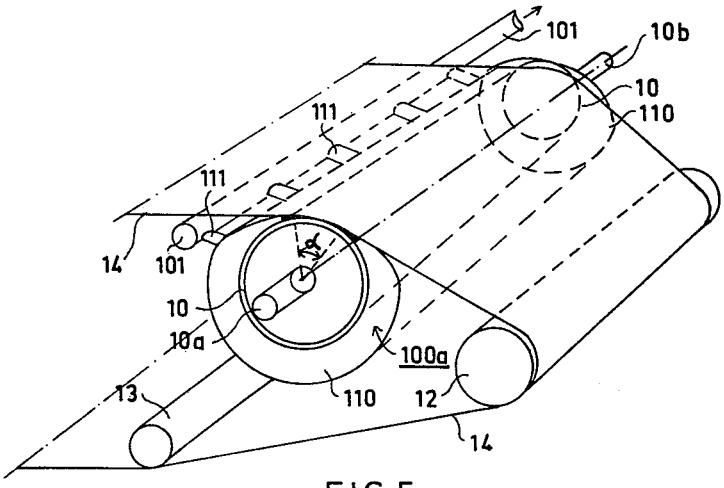
FIG. 5 is a fragmentary schematic perspective illustration of a suction roll of the invention utilized as a couch roll.

Thus, the jacket means 105 provides a hollow region of substantially less than atmospheric pressure which extends around that sector of the exterior surface of the suction roll means which is not lapped by the web W or the felt 34 in the case of the suction roll means 40. As is apparent particularly from FIG. 5, the jacket means communicates through a series of pipes 111 with a header 101 which in turn is connected to a suction pump. In order to drain from the interior of the hollow region of the jacket means 105 water which accumulates therein, at least one of the opposed end walls of the jacket 105 communicates with a pipe 102 which extends first laterally beyond the end wall of the jacket means and then downwardly, forming a suction leg which is connected to the suction jacket and which leads the water to collecting troughs 103 which may be situated in the basement, at a floor below the floor which supports the paper machine, as shown schematically in FIG. 1. The jacket means 105 extends longitudinally along the entire length of the suction roll means and its opposed end walls 110 are sealed with respect to the shell 31 of the suction roll means as illustrated particularly in FIGS. 8 and 14. As is apparent from FIG. 8, the openings or recesses 62 which are formed in the shell 31 do not extend to the region of the shell which cooperates with the seal 115. Thus it will be seen that at the opposed ends of the suction roll means there is a smooth surface portion which is free of any grooves, perforations, or the like, and which is engaged by the end sealing means. As is shown in FIG. 5, the suction roll means has a pair of end journals 10*a* and 10*b*.

As is illustrated, for example, in FIGS. 2, 3, and 6, the longitudinal edge regions of the jacket means 105 carries the longitudinally extending sealing members 106 which have at their exterior regions wear portions 107 made, for example, of a suitable plastic or of a ceramic material. It will be seen from FIGS. 3 and 6 that in the case of the pick-up roll and press roll the wear portions 107 of the sealing means directly engage and press against the felt 34 to contribute to the guiding thereof as well as to cooperate therewith for forming part of a seal.

Figure 12:
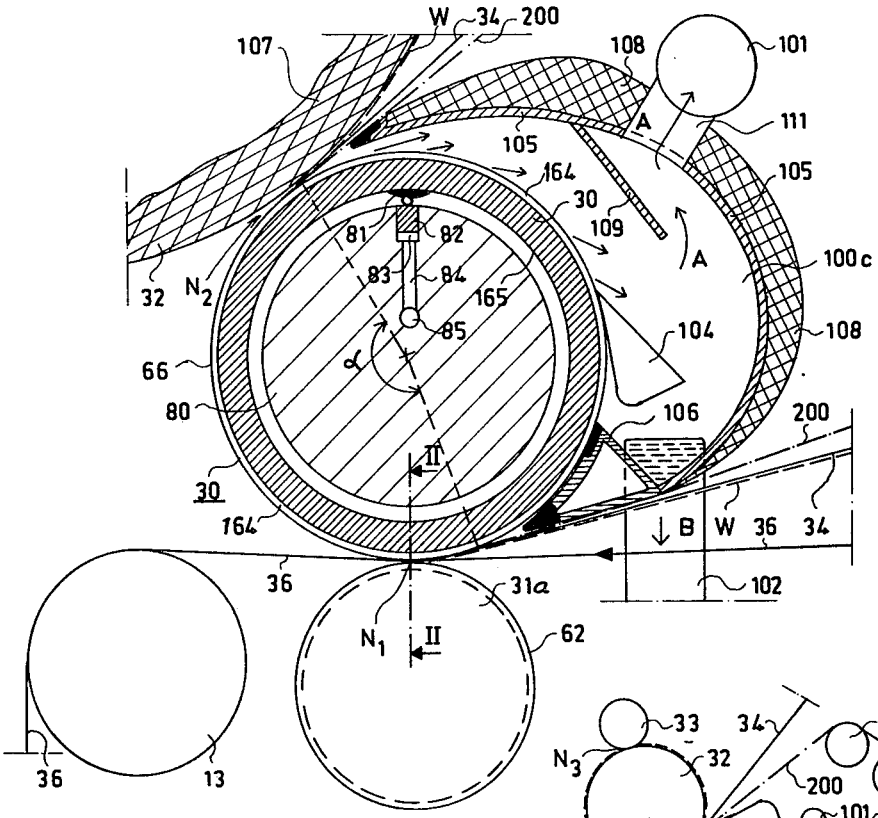
FIG. 12 is a fragmentary sectional schematic illustration, taken in a plane normal to the roll axis, of structure of the invention as utilized in a so-called Sym-Press press section.

As is apparent from FIGS. 2, 3, and 6, while the outer portions of the sealing means 106, 107 serve to guide the felt or wire, the inner portions thereof cooperate with the shell at the exterior surface thereof. While the sealing means may be located closely adjacent to the exterior surface of the shell, there should be a sufficient gap between the sealing means and the exterior surface of the rotating shell to permit water to be flung from the surface of the shell into the suction chamber. In fact, as is indicated in FIGS. 6 and 12, the lower portion of the shell which turns to travel from the hollow region of the jacket means to the portion lapped by the web may be directly engaged by the sealing means whereas the upper portion of the shell which turns toward and is about to enter the hollow region of the jacket means is spaced at a greater distance from the sealing means. Thus the water may be freely flung into the hollow interior of the jacket means as indicated by the arrows in FIG. 6.

Figure 4:
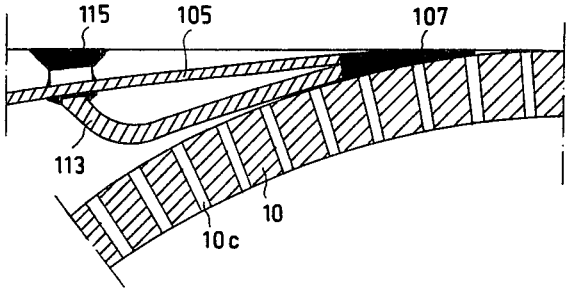
FIG. 4 is a fragmentary sectional elevation showing details of a marginal portion of a jacket means which forms a part of a suction chamber according to the invention.

As is indicated in FIG. 4, the jacket means 105 may be provided at its longitudinal edge regions with a supporting member 113 welded to the metallic sheet which forms the jacket means 105, while at its exterior surface adjacent its longitudinal sealing means the jacket means carries a wear member 115 which serves directly to guide the wire or felt. The sealing means 106, 107 may comprise longitudinal plastic bodies 106 in which the edge regions of the jacket 105 are embedded or to which the edge regions of the jacket 105 are fastened in any suitable way. When the plastic bodies 106 are molded, the ceramic wear portions are situated in the mold and may be provided with recesses or the like which receice portions of the plastic material so as to provide a secure connection between the ceramic elements 107 and the plastic bodies 106. However it is also possible to provide also the portions 107 of a suitable plastic material.

As is indicated in FIG. 6, in the interior of the jacket means 105 there is a splash guard 109 which prevents the water flung from the shell from directly extending into the suction system. Futhermore, within the jacket means there is shown a doctor blade 104 which may, for example, be a foil-type, suction-producing doctor blade, engaging the exterior surface of the shell 30 of the illustrated press roll 31 for maintaining the exterior surface of the suction roll means clean. In the particular example of FIG. 6 where the structure of the invention is shown as forming a press roll, the lower sealing means includes a triangular body 106*a* which carries the wear portions which provide the sealing and guiding features referred to above.

Also, in the case of FIG. 6 it will be seen that at the exterior surface of the jacket means there is a sound-absorbing material 108 in the form of a layer of asbestos, or other sound-absorbing material.

As is apparent from FIGS. 2 and 4, the illustrated shell of the suction-roll means 10 is formed with bores 10*c* passing completely through the shell and spaced relatively close to each other, and the same is true of the bores 21 which are shown passing through the shell of the suction-roll means 20 of FIG. 3. However, in the case of FIGS. 8 and 11, for example, the shell 31 of the upper press roll 30 of the nip $N_1$ is formed with exterior grooves 62 which extend only partly through the shell, so that the latter has an inner uninterrupted surface.

In the case of FIGS. 6, 7, 9, and 10, the illustrated press suction roll 30 includes an inner cylinder or shell 31 which is pierced with a number of openings 65 which pass therethrough but which are spaced at a relatively great distance from each other, so that the number of perforations of the shell illustrated is far less than conventional. The exterior surface of the shell 31 of FIGS. 6, 7, 9, and 10 is formed with a series of longitudinal grooves 64 which are circumferentially distributed about the shell while extending parallel to the axis thereof, and it will be seen that a plurality of the openings 65 are situated along a straight line and communicates with each groove 64. The exterior surface of the shell is covered by a roll-covering 66 formed by winding a suitably profiled strip 70 onto the exterior surface of the shell. The cross-sectional configuration of the strip 70 is illustrated in detail in FIG. 10. However, instead of helically winding an elongated strip 70 onto the exterior surface of the shell 31, a series of rings may be placed on the exterior surface of the shell and situated one next to the other. Such rings will also have the cross section shown in FIG. 10. In this way it is possible to provide around the exterior of the shell 31 extending across the grooves 64 thereof the covering 66 which is illustrated. The strip or rings used to form the covering 66 have at one side surface at least the notches 71 which extend radially and which thus provide communication between the exterior grooves 72 formed by the winding or rings and the grooves 64 formed at the exterior surface of the shell 31. However, as is apparent from FIG. 9, it is not essential that all of the bores formed by the indentations 71 communicate with the grooves 64. However, it is also possible to provide suitable grooves at the exterior of the shell 31 to provide the communication between the indentations 71 and the grooves 64, or it is possible simply to provide the covering 66 at suitable locations with radial grooves through which the outer circumferential grooves 72 will communicate with the axial grooves 64. The manner in which the grooves 72 are formed by the successive windings or rings is apparent from FIG. 10. Thus these grooves 72 will correspond to the grooves 62 shown in FIG. 8. Furthermore, the rings or winding strip 70 has on one side a V-shaped groove 73 and on the opposite side a mating bulge, 74, so that these successive windings or rings will interlock and thus assure that there will be no unravelling of the winding in particular. Of course when the winding is applied or when rings are applied care is take to make certain that the notches 71 are aligned with the grooves 64. In the case of the winding the longitudinal distance from one notch 71 to the next corresponds to the circumferential peripheral distance of from one groove 64 to the next, so that once the winding is properly started with a groove 71 aligned with a groove 64, the remaining grooves 71 will come into alignment with the remaining grooves 64. In the case of rings, however, care is taken to angularly position the rings so that their indentations 71 are aligned with the grooves 64.

Figure 11:
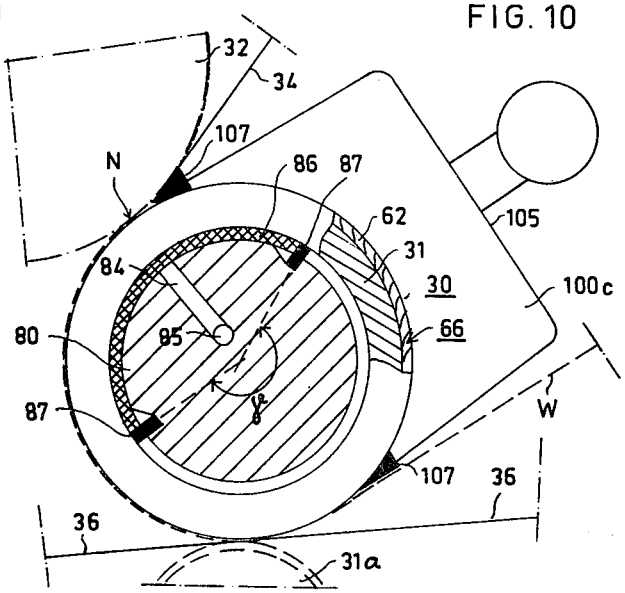
FIG. 11 is a schematic partly sectional illustration in a plane normal to the roll axis, of a structure according to the invention which is utilized as a press roll and which is internally provided with a deflection-compensating means wherein there is a compensating chamber operating by way of a fluid which is under pressure.

Thus, with the present invention it is possible to use suction rolls which have shells which are pierced by openings or it is possible to use shells as shown in FIGS. 8 and 11 which are formed only with exterior recesses which do not pass through the shell, these recesses being formed, for example, by way of a suitable winding strip of suitable cross section or by stacking rings one against the other, as described above. By way of the circumferential grooves 62 it is possible to transmit the suction prevailing in the interior of the jacket means to the exterior surface portion of the suction roll means at its sector $\alpha$ which is lapped by the web, so that it is not essential to provide for the shell apertures which pierce therethrough. It is of advantage in this particular case if the cross-sectional area formed by the exterior grooves 62 is comparatively large, even though it is normally considered desirable to provide grooves of relatively small area, particularly at the exterior surface of the shell, with a view to minimizing possible marking of the web. A grooving of the type illustrated is readily obtained by covering the exterior surface of the shell with rings placed one next to the other and having a suitable cross section which may, for example, be a trapezoidal cross section.

In the embodiment of FIG. 3, where the illustrated pick-up roll structure is shown reversed from right to left with respect to the arrangement of FIG. 1, it will be seen that in the hollow interior of the illustrated suction roll which is pierced by the apertures 21 there is an additional suction box 90 situated precisely in line with the line of detachment of the web W from the wire 14 so that additional suction is provided at the sector $\beta$ which is in alignment with the point of detachment. The illustrated additional interior suction box 90 has sealing strips 91 which directly engage the inner surface of the shell 20. Thus by way of this additional suction box it is possible to enhance the suction effect locally. It is moreover possible in accordance with a further feature of the invention to place against the inner surface of a shell which is pierced through with perforations suitable covering plates which slidably engage the inner surface of the shell. Thus, certain portions of the suction sector $\alpha$ may have locations where no suction effect is desired, and at these locations such stationary slide plates will be provided so as to prevent any suction from acting at these particular locations.

In the press roll embodiment shown in FIGS. 6 and 11 the interior of the shell is provided with a deflection-compensating means. Thus in the embodiment of FIG. 6 the deflection-compensated roll 30 is provided with the bores which pierce therethrough, as described above, and in the interior of the rotary shell there is a stationary massive shaft 80 which rotatably supports the shell through suitable unillustrated bearings. This shaft 80 is formed at its upper portion with a longitudinal groove 83 receiving a longitudinal piston member 82. There may be one or several pistons 82 situated in line with each other. In this case the several pistons 82 will be situated in separate grooves 83 all of which communicate through radial bores 84 with an axial bore 85 which communicates with a source of fluid under pressure urging the piston or pistons 82 outwardly. The piston or pistons 82 press against a slide shoe 81 which slidably engages the inner surface of the rotary shell and which exerts an outward pressure thereagainst to achieve a desired deflection compensation.

In the case of FIG. 11 where the she11 31 is only provided with exterior grooves 62, as shown in FIG. 8, which do not extend through the shell so that the latter is solid at its inner surface region, the shaft 80 carries a pair of sealing members 87 which extend axially and which press against the interior surface of the shell 31 to define the pressure chamber 86 which receives fluid under pressure from the bores 84 and the axial bore 85. Thus in this case deflection compensation will be achieved directly from the fluid under pressure in the gap extending circumferentially between the sealing members 87 and defined between the outer surface of the shaft 80 and the inner surface of the shell 31. Thus as shown in FIG. 11 the deflection-compensating fluid-pressure chamber 86 is situated at the sector $\gamma$.

Of course, in the case of shells which are pierced through with perforations it is not possible to use a pressure chamber shown in FIG. 11 although the use of pistons and a slide shoe as shown in FIG. 6 can be utilized either with shells which are pierced by perforations or with shells which are solid at their inner surface regions.

As is apparent from the above, the method and apparatus of the present invention may be particularly used with paper machine constructions where even conventional perforated suction rolls are utilized. In this case the benefits derived from the method and apparatus of the invention reside primarily in operating techniques and in the achievement of a lowered energy consumption as well as a reduced noise level.

However, it is also possible by way of the method and apparatus of the invention to reduce the manufacturing costs of the paper-manufacturing machine considerably by utilizing the new suction roll construction, the use of which is rendered possible by way of the present invention. This new suction-roll construction is illustrated in FIGS. 6, 7, 9 and 10.

Thus, with the new construction of FIGS. 6, 7, 9 and 10, the shell 31 of the suction roll is pierced with perforations 65 which are far smaller in number than is conventional. It will be seen particularly from FIG. 6 that the bores 65 are circumferentially spaced from each other by a particularly large distance, and the axial distance of the bores 65 which are in line with each other, in a direction parallel to the roll axis, may equal the circumferential distance between these bores 65. Those bores formed by indentations 71 which communicate with the grooves 64 may also have the same spacing as the bores 65. As a result of these bores 65 and bores formed by the indentations 71, the vacuum which prevails in the jacket means 105 is transmitted into the interior of the roll shell 31 inasmuch as the covering 66 is permeable to air. Thus the suction-roll means of FIG. 6 is substantially equivalent to a perforated suction roll having perforations piercing therethrough, even through the number of apertures or holes is exceeding small. Inasmuch as the quantity of air which must be handled by such a roll is exceedingly small, it is not necessary to provide a large total area for the holes which extend through the shell, in order to be assured of proper operation.

In all of the above embodiments where the shell is pierced by openings the suction prevailing within the jacket means 105 is transmitted to the interior of the shell and through this route reaches the sector $\alpha$ which is lapped by the wire, felt, and/or web W at the sector $\alpha$. It will be noted that the jacket means 105 together with the sealing means carried thereby extends over substantially the entire sector of the shell which is not lapped by the felt, wire, and/or web. Thus, substantially the entire exterior surface of the shell which is not lapped by the web is utilized to define part of the hollow region in the interior of the jacket means where substantially less than atmospheric pressure prevails. Thus, the openings formed in the shell cannot communicate with the outer atmosphere before reaching the sector $\alpha$. With the embodiment of FIGS. 8 and 11 the effect of the suction does not extend to the interior of the shell, but the results desired by the invention are still achieved in that the suction acts from the interior of the jacket means 105 through the grooves 62. However, even in the case where the shell is formed, for example, with blind bores which extend inwardly from the exterior surface of the shell toward but terminate short of the interior surface thereof, such blind bores when in communication with the interior of the jacket means 105 will have air withdrawn therefrom, so that these bores are in fact at less than atmospheric pressure when they reach the sector $\alpha$, so as to achieve the results of the invention. Even in the case where a roll having a smooth surface is in contact with a wire mesh utilized to achieve the equivalent of a recessed roll, it is to be noted that the exterior smooth surface of such a roll has a vacuum created within the jacket 105 so that when this exterior surface then comes into engagement with the wire there is still a sufficient vacuum in the interior of the wire mesh to achieve the results of the invention. In this latter case this effect is enhanced by reason of the fact that the seals 106, 107 do not directly engage the exterior surface of the shell. Thus even in this case the slight gap between the seals and the shell utilized to assure flinging of water from the surface of the shell will achieve an evacuation of the wire mesh as the latter approaches and departs from the exterior surface of the shell at the region where it is lapped by the web.

Referring now to FIGS. 12–15, the press section which is fragmentarily illustrated therein includes the three consecutive press nips $N_1$, $N_2$, and $N_3$, the web W being fully supported at all times as it passes through these nips. At the first press nip $N_1$ there are the pair of felts 34 and 36 as well as the lower grooved press roll 31*a* and the upper press roll 30 which in this case is formed only with exterior grooves 164 while inwardly of the grooves the shell 30 has the solid portion 165. The second press nip $N_2$ is defined between the roll 30 and the central press roll 32. This latter roll has a smooth surface and cooperates with the roll 33 to provide the third press nip $N_3$.

Figure 13:
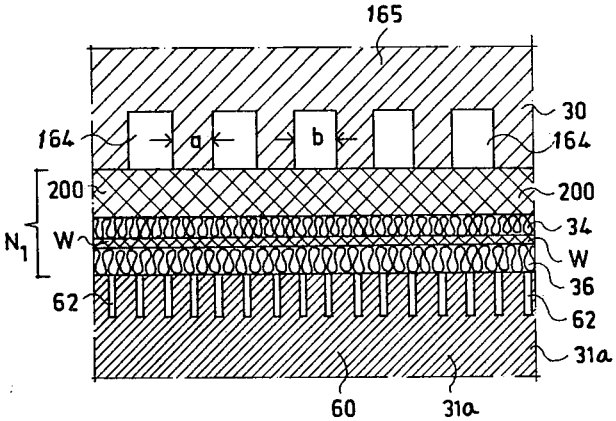
FIG. 13 shows at a scale larger than FIG. 12 in a fragmentary manner the structure at the nip between a pair of rolls of FIG. 12, a section of FIG. 13 being taken along line II—II of FIG. 12 in the direction of the arrows.

As may be seen from FIG. 13, the exterior recesses formed by the grooves 164 provide the shell 30 with a comparatively large open area at its exterior surface. Thus, for example, the axial width b of each groove 164 is substantially equal to the axial width a of the several ribs which separate the grooves 164 from each other. In some instances the ratio a/b may be between 2 and 6.

Figure 15:
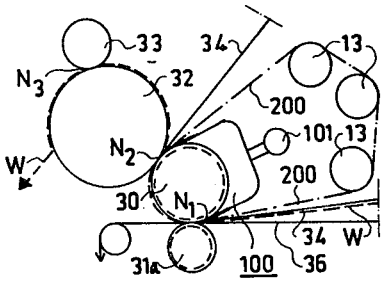
FIG. 15 is a schematic side elevation illustrating how a Sym-Press press section utilizes the method and apparatus of the present invention.

In accordance with a particular feature of the invention, the exterior surface of the shell 30 of FIGS. 12 and 13 is lapped directly by a supporting fabric 200 guided by the rolls 13 as indicated in FIG. 15. Against this supporting fabric 200 there is in the sector $\alpha$ the press felt 34 at the exterior of which the suction roll 30 is lapped by the web W. As is apparent from FIG. 13 this web W is sandwiched at the nip $N_1$ between the felt 34 and the felt 36, the latter engaging the exterior surface of the lower press roll 31*a* which is formed in its body 60 with the grooves 62 which are relatively closely spaced. In this embodiment also at the exterior surface of the shell which is not lapped by the web there is the jacket means 105 which provides the hollow region of substantially less than atmospheric pressure as described above. This construction of FIG. 12 may be substantially identical with that of FIG. 6 which has been described above. However, it will be seen that in this case the sealing means 106, 107 cooperates with the fabric 200 rather than with the felt 34. The path of the suction air is indicated in FIGS. 6 and 12 by the arrows A. The drainage of water takes place by way of the pipes 102 in the direction of the arrows B, as indicated above. Thus, the embodiment of FIG. 12 also has an interior doctor blade 104 and a splash guard 109, while the exterior surface of the jacket is provided with a sound absorbing covering 108.

As is apparent from FIG. 14, the end walls 110 of the jacket 105 are provided at their inner side surface portions with the groove 114 which receives the sealing member 115 and the tube 116 which is provided in its interior with a fluid under pressure which urges the seal 115 against the end surface of the roll 30 in the example of FIG. 14. This of course is in contrast with FIG. 8 where the equivalent structure is shown engaging the outer circumferential surface of the shell at the region of the end thereof.

Moreover, as is shown in FIG. 12, the illustrated shell which does not have openings piercing therethrough is provided in its interior with a deflection-compensating means which is of the same construction as that shown in FIG. 6. However, it is to be understood that deflection compensation is not absolutely essential with the present invention.

With the embodiment of FIGS. 12–15, the grooves 164 may be formed in the body 165 of the shell 30 as by being machined therein, but it is of course also possible to achieve such grooves by winding a strip of suitable cross section or profile on the interior solid body. The grooves may have a constant width from their outer to their inner portions or they may become gradually wider from their outer toward their inner portions. It is also possible to achieve the grooves by placing suitable rings on the inner body of the shell, these rings of course being placed one against the other and if alternate rings are of a relatively large and a relatively small exterior diameter it is possible through this simple expedient to achieve the desired grooves 164. Of course the axial width of the rings will determine the dimensions a and b. If desired the grooves 164 may be achieved by simultaneously winding a pair of strips onto the inner roll body.

The supporting endless fabric 200 of the embodiment of FIGS. 12–15 is comparatively thick and sturdy while at the same time having a comparatively high permeability to air. In addition this fabric 200 is relatively rigid in a transverse direction. The internal fabric structure of the endless fabric 200 is such that it is an easy matter to create the desired seal at the interior of the jacket means 105. Thus, the inner construction of the fabric 200 should not be loose enough to permit large quantities of air to be sucked into the jacket 105. For example, the supporting fabric 200 may comprise one or more woven fabric sheets which have a relatively open mesh and to which there are bonded suitable natural or synthetic fibers, or a combination thereof which have been treated so as to achieve for the supporting fabric 200 the properties referred to above.

Of course, the invention is not to be confined to the specific details of the embodiments described above merely by way of example. The details of the invention of course may vary within the scope of the invention concept defined in the claims which follow below.

What is claimed is:

1. A method of subjecting a travelling fabric in the press section or web dewatering section of a paper-making machine to a suction effect when travelling over a suction-roll comprising the steps of:

partially lapping a first sector of a rotary suction roll with a travelling air-permeable fabric means adapted to support a web, said suction-roll comprising a solid, non-perforated inner portion and a circumferentially extending outer portion, said outer portion having circumferentially extending channels formed therein; and maintaining at a reduced pressure which is substantially less than atmospheric pressure a region situated at the exterior of said suction roll, said region being in sealed communication with a second sector of said suction-roll comprising substantially the entire exterior surface of said suction-roll which is not lapped by said fabric means such that said reduced atmospheric pressure is transmitted through said circumferentially extending channels which extend through said first suction-roll sector.

2. In a method as recited in claim 1 and wherein the paper machine includes a press roll and a felt-reconditioning roll, and at least one of the rolls being said suction-roll.

3. In a method as recited in claim 2 and wherein said press roll is said suction roll, and including the steps of situating the latter roll over a recessed roll which with twin-felts defines a press nip, and situating said suction roll also in engagement with a central smooth-surfaced roll for providing a second press nip, while also providing an additional third press nip at said smooth-surfaced central roll.

4. In a method as recited in claim 1 and wherein said suction roll includes an outer shell, said channels comprising recesses distributed longitudinally and circumferentially around said shell and extending from the exterior thereof only partly through said shell toward the interior thereof, so that said recess can communicate with the exterior of said shell but not with the interior thereof, and providing said reduced pressure in said suction roll second sector by communication of said recesses with said region at least during part of each revolution of said shell.

5. In a method as recited in claim 1 and including the step of compensating for deflection of said roll.

6. In a method as recited in claim 1 and wherein the suction-roll includes an outer shell formed with said channels comprising recesses which extend only part of the way from an exterior surface of said shell toward an interior surface thereof, and including the step of guiding around said shell over said air-permeable fabric means a web, said fabric means preventing direct contact between said shell and said web.

7. In a method as recited in claim 6 and wherein said recesses in said shell occupy a relatively large portion of the exterior surface thereof and would without said endless fabric means provide undesirable markings in said web, while said endless fabric means has a sufficient thickness and firmness, while still being air-permeable, to prevent marking of the web by the recessed exterior surface of said shell.

8. In a method as recited in claim 6 and including the step of situating between said endless fabric means and said web an endless felt which at any given instant is situated between said web and said endless fabric means.

9. In a method as recited in claim 6 and wherein said suction roll forms part of a press section of the paper machine, and providing at said suction roll the first and second nips of the press section.

10. In the press or web dewatering section of a paper-manufacturing machine, rotary suction-roll means for guiding a travelling fabric means adapted to support a web while being partially lapped thereby over a first sector thereof, said suction roll means comprising a solid, non-perforated inner portion and a circumferentially extending outer portion, said outer portion having circumferentially extending channels formed therein, jacket means situated at the exterior of said suction-roll means and defining with a second sector of said suction-roll means comprising substantially the entire exterior surface thereof which is not lapped by said web a hollow region bounded by an inner surface of said jacket means and said suction-roll means second sector, said jacket means having opposed longitudinal edge regions which extend substantially parallel to the axis of said suction-roll means and opposed end walls which extend between said edge regions, said jacket means carrying along said edge regions and end walls sealing means engaging said suction-roll means to an extent sufficient for maintaining said hollow region substantially closed off from the outer atmosphere while communicating with said circumferentially extending channels, and suction means operatively connected with said jacket means for maintaining said hollow region at a reduced pressure substantially less than atmospheric pressure to provide through said hollow region a pressure in said channels which is sufficiently low to cause air flow through said fabric means inwardly into said channels.

11. The combination of claim 10 and wherein at least one endless air-permeable fabric means comprising a felt means is lapped together with an overlying web around said suction-roll means first sector, said fabric means preventing direct contact between said suction-roll means and the portion of said web which overlies said fabric means, and said sealing means having an inner portion extending along each of said longitudinal edge regions of said jacket means and directed toward the exterior surface of said suction-roll means and an outer portion extending along each of the longitudinal edge regions of said jacket means and directly engaging said endless fabric means for providing a sealing and guiding surface for said endless fabric means.

12. The combination of claim 10 and wherein said suction-roll means includes an outer shell having a hollow interior, and deflection-compensating means situated in the hollow interior of said shell for compensating for deflection thereof.

13. The combination of claim 12 and wherein said shell has an inner uninterrupted surface and is entirely solid at least at the region of said inner surface so that the hollow interior of said shell cannot communicate through said shell with the exterior thereof, and said deflection-compensating means including a means in said shell defining therein a chamber formed in part by said inner surface of said shell and means communicating with said chamber for supplying a fluid under pressure thereto.

14. The combination of claim 10 and wherein said suction-roll means includes an outer shell formed with said channels defined by recesses which extend inwardly from an outer surface of said shell only part of the way therethrough, said fabric means extending around said shell between the latter and a web lapped thereby for preventing direct contact between the web and said shell, said fabric means being air-permeable.

15. The combination of claim 14 and wherein an endless felt also laps said shell of said suction roll means and is situated between said fabric means and a web which laps said suction-roll means.

16. The combination of claim 14 and wherein said recesses in said shell are in the form of a series of grooves which circumferentially surround and are distributed longitudinally along said shell, the latter having ribs extending circumferentially around and distributed along said shell and separating said grooves from each other, and the axial dimension of said ribs being substantially equal to the axial dimension of said grooves so that the latter occupy a sufficiently large space to achieve an effective suction through a web which laps said suction-roll means.

17. The combination of claim 16 and wherein the ratio of the axial width of said ribs to the axial width of said grooves is between 1 and 6.

18. The combination of claim 10 and wherein said opposed ends of said jacket means terminate adjacent said suction-roll means in edge regions formed with hollow grooves the interiors of which are directed toward said suction roll means, said sealing means including sealing members situated partly in said grooves and engaging the exterior surface of said suction roll means, and pressure members situated in said grooves and engaging and pressing against said sealing members for urging the latter toward said suction-roll means.

* * * * *